US006774070B1

(12) United States Patent
Kenmochi et al.

(10) Patent No.: US 6,774,070 B1
(45) Date of Patent: Aug. 10, 2004

(54) DISPOSABLE WIPE-OUT SHEET AND PROCESS FOR MAKING THE SAME

(75) Inventors: Yasuhiko Kenmochi, Kagawa (JP); Yoshinori Tanaka, Kagawa (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 09/958,849

(22) PCT Filed: Apr. 12, 2000

(86) PCT No.: PCT/JP00/02389

§ 371 (c)(1),
(2), (4) Date: Oct. 11, 2001

(87) PCT Pub. No.: WO00/60993

PCT Pub. Date: Oct. 19, 2000

(30) Foreign Application Priority Data

Apr. 13, 1999 (JP) ..... 11-105956

(51) Int. Cl.[7] ..... D04H 1/00; D04H 13/00; B32B 5/26

(52) U.S. Cl. ..... 442/352; 442/353; 442/361; 442/364; 442/382; 442/389; 442/394; 442/401

(58) Field of Search ..... 442/352, 353, 442/361, 364, 382, 389, 394, 401, 409

(56) References Cited

FOREIGN PATENT DOCUMENTS

| | | |
|---|---|---|
| CN | 1158283 A | 12/1996 |
| EP | 0 774 229 A2 | 5/1997 |
| JP | 5-192284 | 8/1993 |
| JP | 6-24665 | 4/1994 |
| JP | 9-135798 | 5/1997 |
| JP | 10-272081 | 10/1998 |

*Primary Examiner*—Arti R. Singh
*Assistant Examiner*—Christopher Pratt
(74) *Attorney, Agent, or Firm*—Butzel Long

(57) ABSTRACT

A disposable wipe-out sheet That comprises a plurality of synthetic resin filaments bonded to a synthetic resin base sheet. The synthetic resin filaments comprise core-sheath type conjugated fiber in which the sheath has a melting point that is at least 30° C. lower than the melting point of the core.

18 Claims, 5 Drawing Sheets

DISPOSABLE WIPE-OUT SHEET AND PROCESS FOR MAKING THE SAME

TECHNICAL FIELD OF THE INVENTION

This invention relates to a disposable wipe-out sheet suitable for wiping out dust and/or dirt from floor or wall surfaces.

RELATED ART

Japanese Patent Application Publication No. 1997-135798 describes a disposable wipe-out sheet comprising a heat-sealable synthetic resin base sheet and a plurality of heat-sealable filaments bonded to the base sheet and extending in one direction. These filaments are obtained by deregistering or opening a tow of continuous filaments and bonded to the base sheet by a plurality of sealing lines extending transversely of the filaments and arranged intermittently in the one direction. An assembly of these filaments obtained by deregistering the tow is bulky and, along the sealing lines formed by locally pressing this assembly under heating, a plurality of filaments are molten and solidified to form a high density film bonded to the base sheet. Between each pair of the adjacent sealing lines, filaments form convex bridge-like portions describing arcs which are convex upward from the base sheet.

One of measures to improve a productivity per unit time of the wipe-out sheet of prior art is to feed the heat-sealable synthetic resin base sheet and the filaments at a high velocity onto a production line so that the base sheet and filaments may be heat-sealed together at a high velocity corresponding to said high feeding velocity. To improve the heat-sealing velocity, it is preferable to use synthetic resin having a relatively low melting point for both the base sheet and the filaments and to use the press having high temperature and pressure. However, if a temperature of the press is adjusted to a level substantially higher than the melting point of the synthetic resin, both the base sheet and the filaments would be deformed due to heat transferred from the press in their regions other than their regions in which the sheet and the filaments. As a result, it is difficult for the wipe-out sheet to maintain its initial shape. Accordingly, an improvement of the productivity by adopting a higher press temperature is inevitably limited.

It is an object of this invention to design a disposable wipe-out sheet so that a relatively high press temperature can be employed during a process for making the wipe-out sheet.

DISCLOSURE OF THE INVENTION

According to the invention, there is provided a disposable wipe-out sheet comprising a heat-sealable synthetic resin base sheet and a plurality of heat-sealable synthetic resin long fibers heat-sealed with the base sheet and extending in one direction, wherein the long fibers are heat-sealed with the base sheet by a plurality of sealing lines arranged intermittently in the one direction, wherein: the long fibers comprise core-sheath type conjugated fibers wherein a melting point of the sheath is lower than a melting point of the core and such difference of the melting points is at least by 30° C.

According to the invention, there is also provided a process for making a disposable wipe-out sheet comprising a heat-sealable synthetic resin base sheet and a plurality of heat-sealable synthetic resin long fibers heat-sealed with the base sheet and extending in one direction, wherein said long fibers are heat-sealed with the base sheet by a plurality of sealing lines arranged intermittently in the one direction, wherein:

the long fibers comprise core-sheath type conjugated wherein a melting point of the sheath is lower than a melting point of the core and such difference of the melting points is at least by 30° C.; a difference between a melting point of the base sheet as measured along the sealing lines and a melting point of the sheath in the conjugated fiber is less than 20° C.; and the base sheet and the long fibers are bonded together at a temperature higher than the melting point of the sheath in the conjugated fiber by 20° C. or more but lower than the melting point of the core in the conjugated fiber.

DESCRIPTION OF THE PREFERRED EMBODIMENTS

Details of a disposable wipe-out sheet according to this invention will be more fully understood from the description given hereunder with reference to the accompanying drawings.

Figure 1:
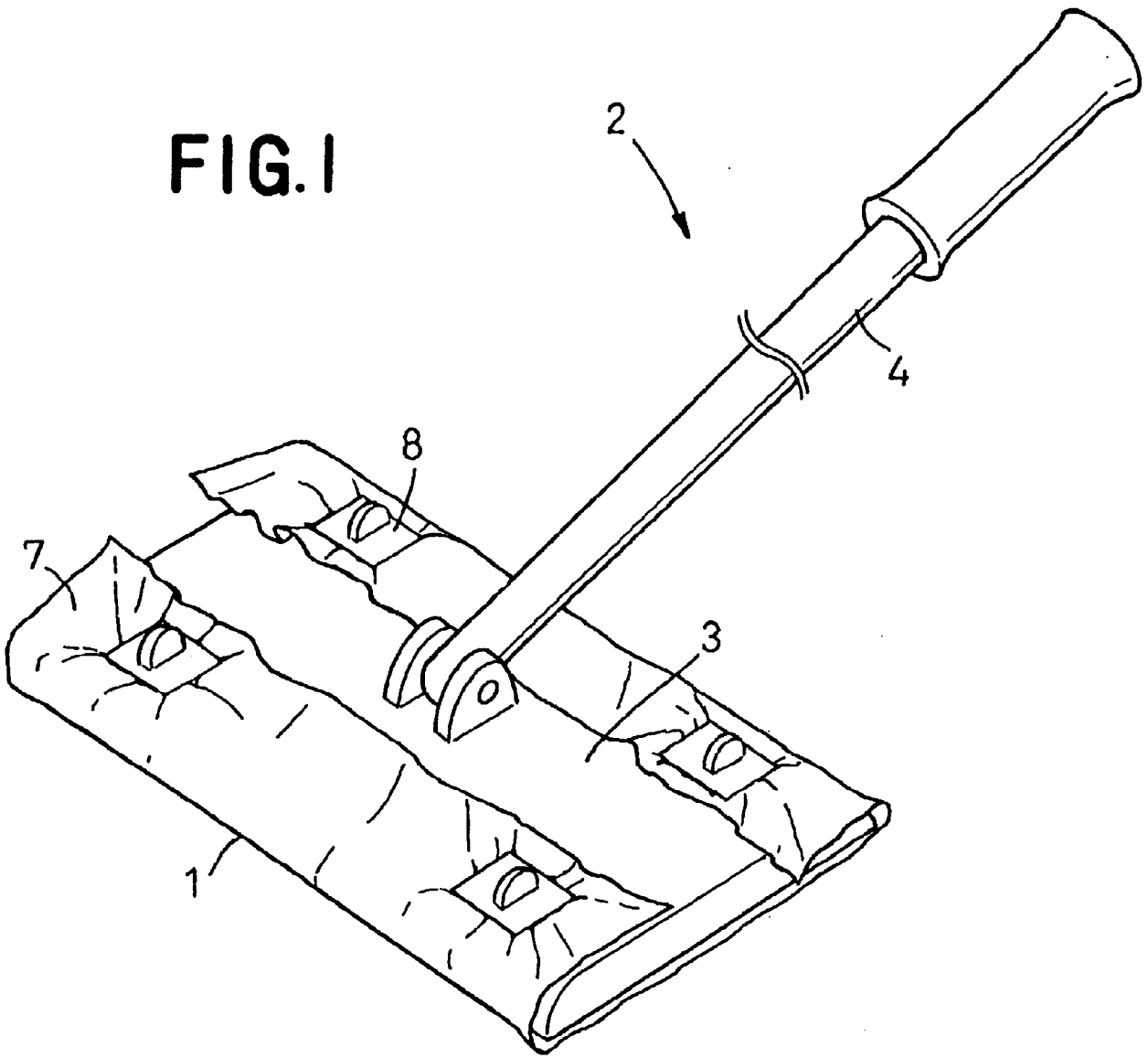
FIG. 1 is a perspective view showing a wipe-out sheet according to this invention as being actually used.

FIG. 1 is a perspective view showing a holder 2 with a disposable wipe-out sheet 1 attached thereto. The holder 2 comprises a base plate 3 and a stick 4. The wipe-out sheet 1 placed against the lower surface of the base plate 3 has its opposite long side edge regions 7 folded back onto the upper surface of the base plate 3 and fastened to the upper surface by means of clips 8 mounted on the base plate 3. Dust and/or dirt on floor or wall surfaces may be wiped out by the wipe-out sheet 1 attached to the holder 2 with the stick 4 gripped in user's hands.

Figure 2:
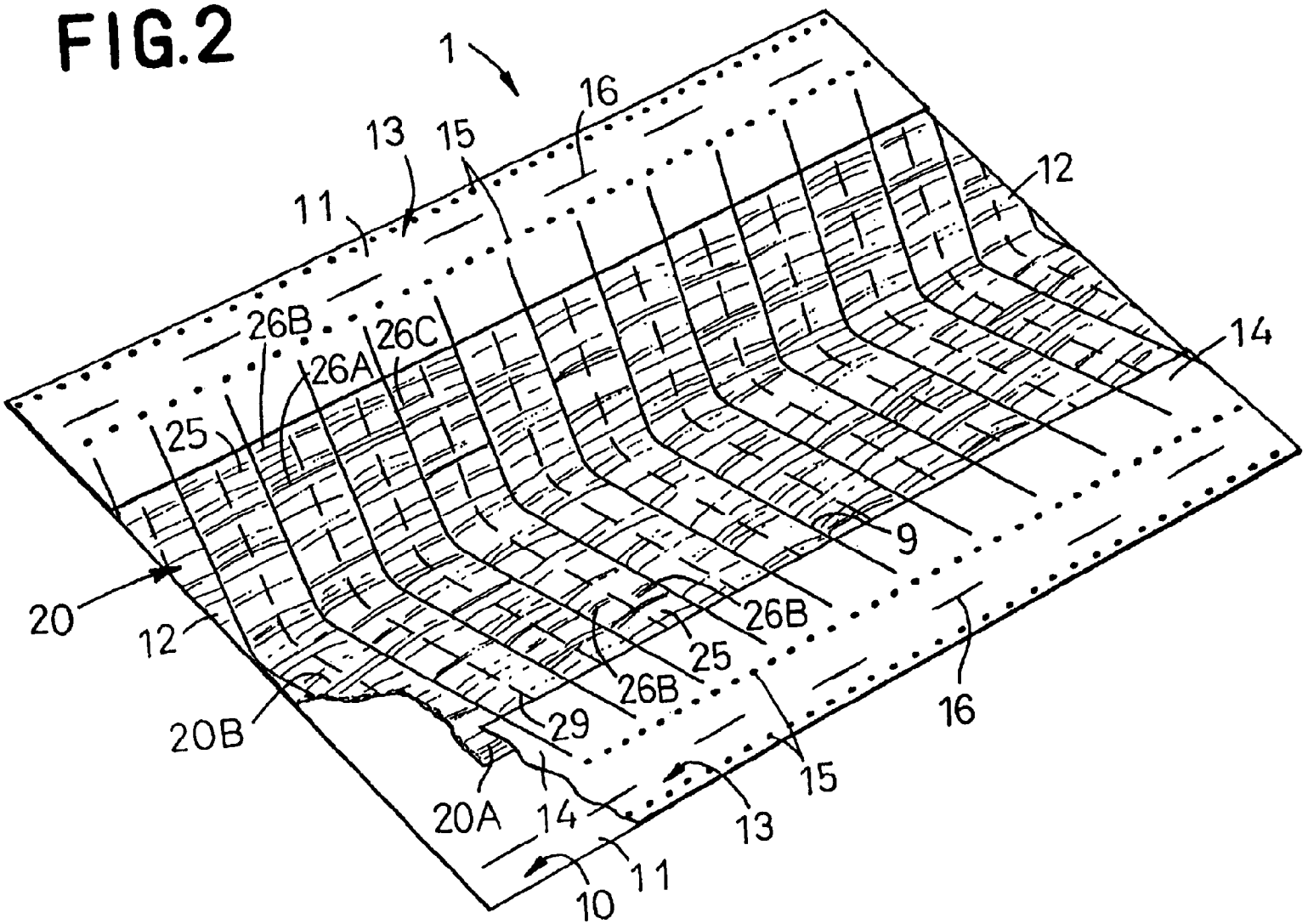
FIG. 2 is a perspective view showing the wipe-out sheet alone.

FIG. 2 is a perspective view showing the same wipe-out sheet 1 as the wipe-out sheet 1 shown by FIG. 1 as partially broken away. The wipe-out sheet 1 is herein illustrated as have been detached from the base plate 3 and developed with its wiper surface facing upward. The wipe-out sheet 1 comprises a base sheet layer 10 made of a heat-sealable synthetic resin film or nonwoven fabric and a wiper layer 20 formed by a plurality of heat-sealable long fibers or filaments 25 bonded to the upper surface of the base sheet layer 10.

The base sheet layer 10 is of a rectangular shape defined by a pair of opposite long side edge regions 11 extending parallel to each other and a pair of opposite short side edges 12 extending also parallel to each other. Band-like reinforcing sheets 13 made of a synthetic resin film are heat-sealed with the opposite side edge regions 11 at a plurality of spots 15 in order to improve a tear strength of these side edge regions 11. Referring to FIG. 2, a pair of opposite side edge regions of the wiper layer 20 are covered with inner edge regions 14 of the respective reinforcing sheets 13. The side edge regions 11 of the base sheet layer 10 are formed with a plurality of slits 16 extending through these side edge regions 11 as well as the respective reinforcing sheets 13.

These slits 16 facilitate the wipe-out sheet 1 to be attached to the holder 2 by means of the clips 8.

The wiper layer 20 comprises a plurality of long fibers 25, i.e., continuous filaments extending substantially parallel to the side edge regions 11 of the base sheet layer 10. These long fibers 25 are heat-sealed with the base sheet layer 10 along a plurality of sealing lines 9 intermittently arranged to extend between the pair of opposite side edge regions 11 substantially parallel to each other toward the opposite short side edge regions 12 of the base sheet layer 10. The respective long fibers 25 partially define relatively long bridge-like portions 26A connecting each pair of the adjacent sealing lines 9 and relatively short fluffy portions 26B formed by severing the remaining long fibers 25 between each pair of the adjacent sealing lines 9. The severed portions define slits 29 extending in the direction intersecting the direction in which the long fibers 25 extend. Such wiper layer 20 may be obtained by a process comprising the following steps. First, a tow which is a bundle of the long fibers 25 is deregistered or opened to have a predetermined width. These long fibers 25 are fed onto a web of heat-sealable base sheet which is continuously fed. Then the sealing lines 9 extending across the web of heat-sealable base sheet are formed intermittently with respect to the direction in which the web of heat-sealable base sheet is fed. Between each pair of the adjacent sealing lines 9, the long fibers 25 are severed intermittently across the direction in which the long fibers 25 are fed.

Figure 3:
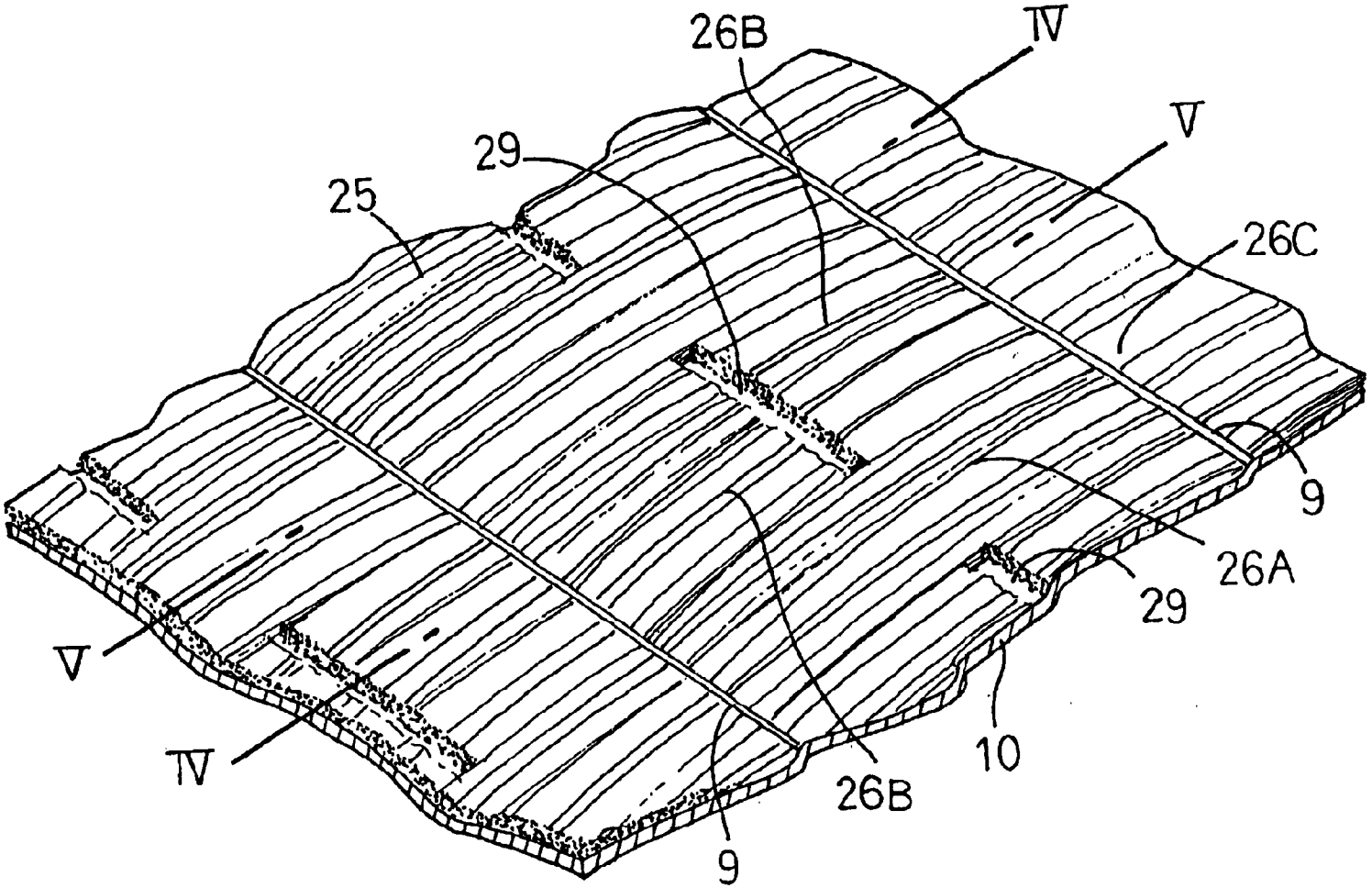
FIG. 3 is a perspective view showing an important part of the wipe-out sheet.

FIG. 3 is a fragmentary scale-enlarged perspective view showing an important part of FIG. 2. The sealing lines 9 are formed by heating the base sheet layer 10 together with an assembly of the long fibers 25 under a pressure exerted to them so that they are pressed against each other in the direction of thickness. The assembly of the long fibers 25 is bulky and the finished wipe-out sheet 1 is formed with a plurality of troughs 26C in the vicinity of the sealing lines 9 compressed at a high density as a result of the heating under a pressure. Lengths of the long fibers 25 continuously extending between each pair of the adjacent sealing lines 9 form the convex bridge-like portions 26A describing arcs which are convex upwardly of the base sheet layer 10. The lengths of the long fibers 25 extending each pair of the adjacent sealing lines 9 are partially severed in two, respectively, to form the fluffy portions 26B.

The heat-sealable base sheet having been assembled with the wiper layer 20 in the manner as has been described above may be provided along its opposite long side edge regions with the reinforcing sheets 13 bonded thereto and then cut into predetermined lengths to obtain the individual wipe-out sheets 1. The wiper layer 20 is defined preferably 10–100 mm, more preferably 20–60 mm inside the outermost edges of the long side edge regions 11 of the base sheet layer 10. With such arrangement, the wipe-out sheet 1 can be easily clipped to the base plate 3 (See FIG. 1) and the long fibers 25 can be economically used because the long fibers 25 are gathered to the transversely middle zone of the wipe-out sheet 1. The opposite short side regions of the wiper layer 20 may be substantially aligned and sealed with the opposite short side edge regions 12 of the base sheet layer 10, respectively, to improve a tear strength of the base sheet layer 10 along its opposite short side edge regions 12.

Figure 4:
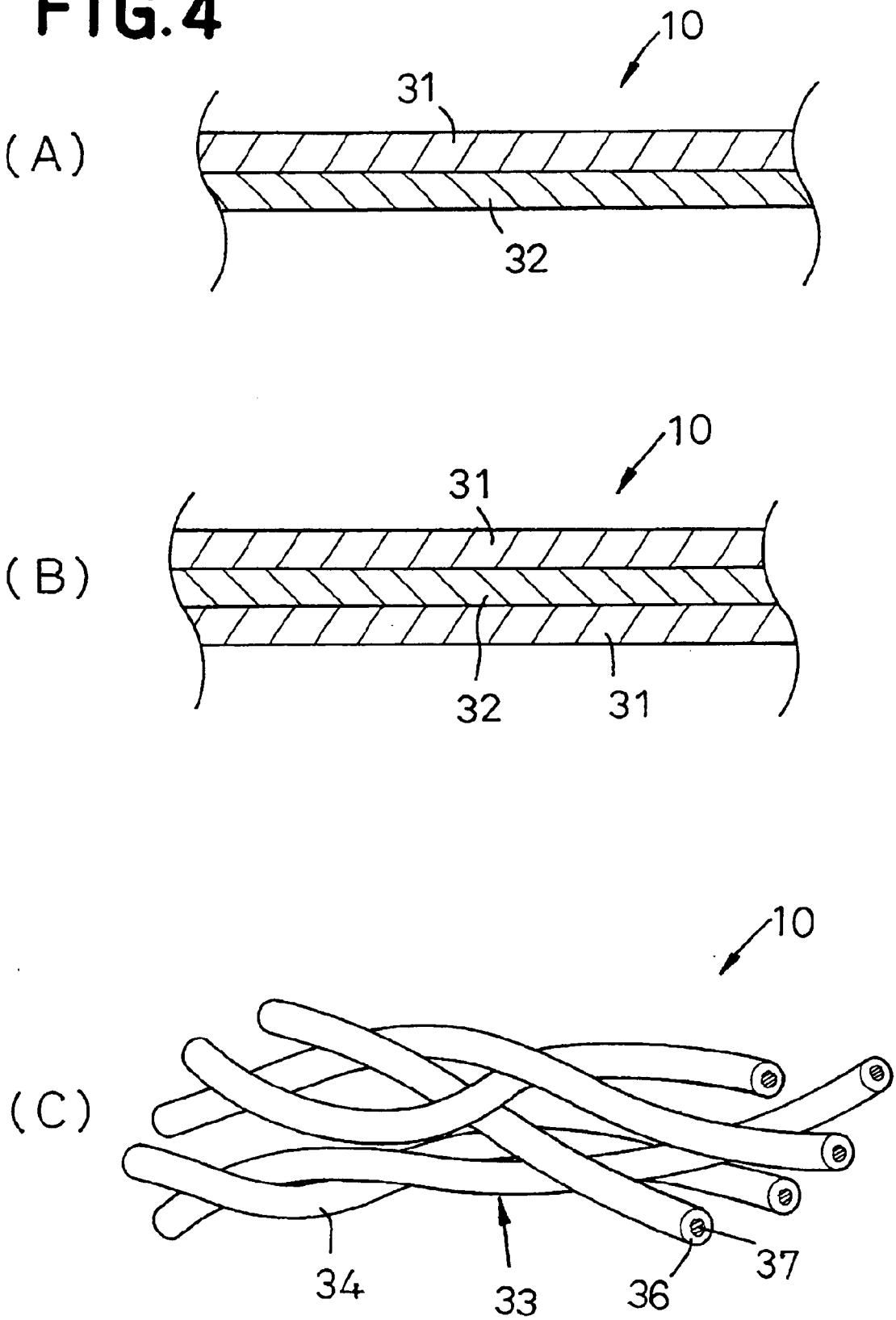
FIG. 4 is a fragmentary diagram of the base sheet layer realized in different manners (A)–(C)

FIG. 4 is a fragmentary sectional illustrating the base sheet layer 10 realized in different manners as illustrated by (A)–(C). FIG. 4(A) illustrates a two layer laminated base sheet layer 10 comprising two different types of synthetic resin, i.e., a heat-sealable layer 31 participating in sealing with the long fibers 25 and a non-heat-sealable layer 32 not participating in sealing with the long fibers 25. The heat-sealable layer 31 has a melting point lower than a melting point of the non-heat-sealable layer 32 and is easily sealed with the long fibers 25. A difference between the melting points of these two base layers 31, 32 is preferably 70° C. or higher so that the non-heat-sealable base layer 32 may be free from deformation as well as damage even when the heat-sealable base layer 31 is heated at a temperature higher than its melting point. The base sheet layer 10 of this construction can be obtained using polyethylene resin as the heat-sealable base layer 31 and polyester resin as the non-heat-sealable base layer 32.

FIG. 4(B) illustrates a three layer laminated base sheet layer 10 comprising two different types of synthetic resin. Upper and lower layers are defined by the heat-sealable base layers 31 and the non-heat-sealable base layer 32 is disposed between the heat-sealable layers 31. The base sheet layer 10 of this construction enables the long fibers 25 to be heat-sealed with both surfaces of this base sheet layer 10.

FIG. 4(C) illustrates a base sheet layer 10 made of a nonwoven fabric comprising core-sheath type conjugated fiber 33. Component fibers of the conjugated fiber 33 are mechanically entangled and/or heat-sealed together to form the nonwoven fabric. In the conjugated fiber 33, the sheath 36 has a melting point lower than a melting point of the core 37 preferably at least by 30° C., more preferably at least by 70° C. With the base sheet layer 10 of this construction, the core 37 maintains its initial shape even when the sheath 36 is molten to be heat-sealed with the long fibers 25. Accordingly, the base sheet layer 10 itself also can maintain its function as well as its shape. This base sheet layer 10 enables the long fibers 25 to be heat-sealed with both surfaces of the base sheet layer 10. Polyethylene resin may be used for the sheath 36 and polypropylene resin may be used for the core 37.

Figure 5:
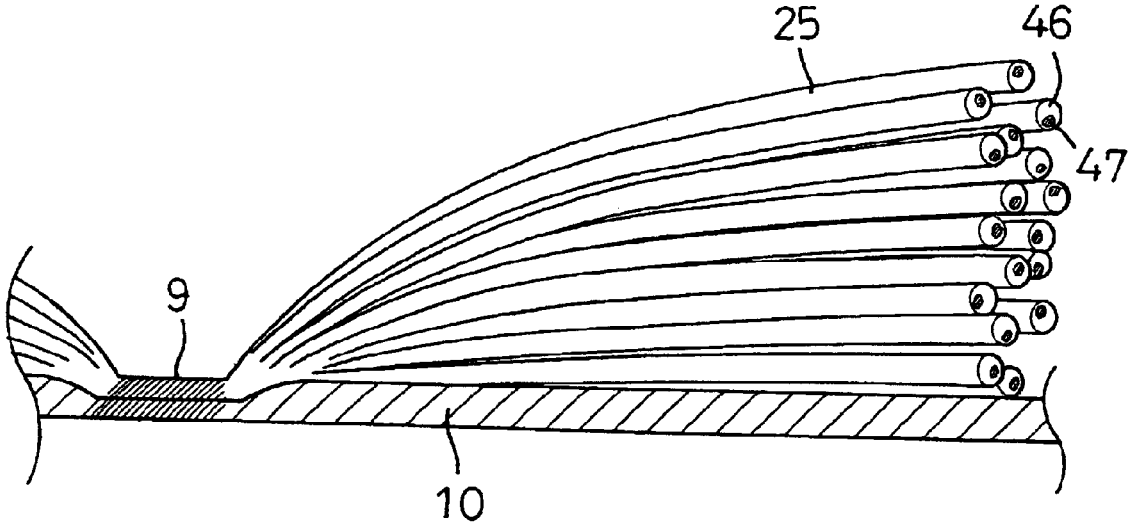
FIG. 5 is a sectional view showing the long fibers.

FIG. 5 is a fragmentary sectional view illustrating the long fibers 25 forming the bridge-like portion 26A. While the long fibers 25 comprise core-sheath type conjugated fiber, preferably comprise mechanically crimped or heat-crimped conjugated fiber, FIG. 5 illustrate the long fibers 25 having no crimps. The sheath 46 has a melting point lower than a melting point of the core preferably at least by 30° C., more preferably at least by 70° C. When the long fibers 25 are pressed against the base sheet layer 10 under heating in order to seal them with the base sheet layer 10, a press temperature is adjusted to a temperature higher than the melting point of the sheath 46 preferably by 20° C. or more, and more preferably by 60° C. but lower than the melting point of the core 47. At such press temperature, the core 47 maintains each of the long fiber 25 in its initial shape, for example, so that this long fiber 25 reliably describes the arc. Polyethylene resin may be used for the sheath 46 and polyester resin may be used for the core 47.

It is desired that the base sheet layer 10 and the long fibers 25 are simultaneously molten and thereby rapidly as well as reliably heat-sealed together. To this end, materials for the base sheet layer 10 and the long fibers 25 are preferably selected so that a difference between the melting points of the components to be heat-sealed together may be limited to a level less than 20° C. For example, the heat-sealable layer 31 of base sheet layer 10 illustrated in FIG. 4 and the conjugated fiber's sheath 46 constituting the long fibers 25 illustrated in FIG. 5 are preferably made of polyethylene resin having substantially the same melting point.

According to this invention, the core-sheath type conjugated fiber is used as material for the long fibers forming the wiper layer of the wipe-out sheet so that the melting point of the sheath is lower than the melting point of the core preferably at least by 30° C., more preferably at least by 70° C. Selection of such relationship between the core and the sheath in the conjugated fiber enables the wipe-out sheet to be mass-produced at a high rate without deformation of the long fibers even if a temperature of the press used to seal the long fibers with the base sheet layer is relatively high.

According to this invention, the synthetic resin sheet forming the base sheet layer of the wipe-out sheet also comprises the layer having a relatively high melting point and the layer having a relatively low melting point so that the layer having the relatively low melting point may be heat-sealed with the long fibers. In this manner, the productivity for the wipe-out sheet is further improved.

What is claimed is:

1. A disposable wipe-out sheet comprising:

a heat-sealable synthetic resin base sheet; and a plurality of heat-sealable synthetic resin fibers heat-sealed with said base sheet and extending in a first direction, wherein said fibers are heat-sealed with said base sheet alone a plurality of sealing lines arranged intermittently in said first direction, said fibers comprising core-sheath conjugated fibers in which a melting point of the sheaths is lower than a melting point of the cores and such difference of the melting points thereof is at least 30° C.

2. The disposable wipe-out sheet according to claim 1, wherein said difference of the melting points is at least 70° C.

3. The disposable wipe-out sheet according to claim 2, wherein the heat-sealable synthetic resin fibers are heat-sealed by pressing the fiber at a temperature that is at least 60° C. higher than the melting point of the sheaths.

4. The disposable wipe-out sheet according to claim 1, wherein said cores of said core-sheath conjugated fibers comprise polyester resin and said sheaths comprise polyethylene resin.

5. The disposable wipe-out sheet according to claim 1, wherein said core-sheath conjugated fibers are crimped.

6. The disposable wipe-out sheet according to claim 1, wherein a difference between a melting point of said base sheet as measured along said sealing lines and a melting point of said sheaths of said core-sheath conjugated fibers is less than 20° C.

7. The disposable wipe-out sheet according to claim 1, wherein said base sheet comprises a nonwoven fabric of core-sheath conjugated fibers, and a difference between a melting point of the sheaths of said nonwoven fabric and a melting point of the sheaths in said conjugated fiber constituting said fibers is less than 20° C. and wherein both of these sheaths are bonded to one another.

8. The disposable wipe-out sheet according to claim 1, wherein said base sheet comprises a laminated sheet composed of at least two component synthetic resin sheets of which one has a lower melting point and the component synthetic resin sheet having the lower melting point and the sheaths of said core-sheath conjugated fibers constituting said fibers are bonded together.

9. The disposable wipe-out sheet according to claim 8, wherein, in said laminated sheet, a difference between the melting point of the component sheet bonded to the sheaths of said conjugated fibers and the melting point of the component sheet not bonded to said sheathes is at least 30° C.

10. The disposable wipe-out sheet according to claim 9, wherein said difference of the melting point of the component sheet bonded to the sheath of said conjugated fibers and the melting point of the component sheet not bonded to said sheaths is at least 70° C.

11. The disposable wipe-out sheet according to claim 1, wherein the sheaths of said core-sheath conjugated fibers of said base sheet have a melting point that is at least 30° C. lower than a melting point of the cores.

12. The disposable wipe-out sheet according to claim 11, wherein said difference of the melting points is at least 70° C.

13. The disposable wipe-out sheet according to claim 1, wherein the heat-sealable synthetic resin fibers are heat-sealed by pressing the fibers at a temperature that is at least 60° C. higher than the melting point of the sheaths.

14. A process for making a disposable wipe-out sheet comprising the steps of:

providing a heat sealable synthetic resin base sheet and a plurality of heat-sealable synthetic resin fibers; and heat-sealing said plurality of fibers with said base sheet so that said plurality of fibers extend in one direction, said fibers being heat-sealed with said base sheet along a plurality of sealing lines arranged intermittently in said one direction, said plurality of fibers comprising core-sheath conjugated fibers wherein a melting point of sheaths thereof is lower than a melting point of cores thereof by at least 30° C.;

a difference between a melting point of said base sheet along said sealing lines and a melting point of said sheaths of said core-sheath conjugated fibers is less than 20° C.; and said base sheet and said plurality of fibers are bonded together at a temperature higher than the melting point of the sheaths of said conjugated fibers by 20° C. or more by lower than the melting point of the core of said conjugated fibers.

15. The process according to claim 14, wherein said difference of the melting point of the base sheet and the melting point of said cores is at least 70° C. and said base sheet is bonded to said fibers at a texture higher than a melting point of the sheaths in said core-sheath conjugated fibers by 60° C. or more but lower than a melting point of the cores of said core-sheath conjugated fibers.

16. The process according to claim 14, wherein said base sheet comprises a nonwoven fabric made of core-sheath conjugated fibers in which a difference between a melting point of the sheaths of said nonwoven fabric and a melting point of the sheathes of said core-sheath conjugated fibers constituting said fibers is less than 20° C. and the sheaths are bonded to one another.

17. The process according to claim 16, wherein the sheaths and the cores of the core-sheath conjugated fibers constituting said base sheet have melting points that differ by at last 70° C.

18. The process according to claim 14, wherein said base sheet comprises a laminated sheet consisting of at least two component synthetic resin sheets having different melting points and wherein one of said two component sheets having a relatively lower melting point and the sheaths of said core-sheath conjugated fibers constituting said fibers are bonded together.

* * * * *

UNITED STATES PATENT AND TRADEMARK OFFICE

CERTIFICATE OF CORRECTION

PATENT NO. : 6,774,070 B1 
DATED : August 10, 2004
INVENTOR(S) : Yasuhiko Kenmochi and Yoshinori Tanaka It is certified that error appears in the above-identified patent and that said Letters Patent is hereby corrected as shown below:

Title page,
Itme [73], Assignee, change "Uni-Charm Corporation" to -- Uni-Charm Co., Ltd. --

Signed and Sealed this

Eleventh Day of January, 2005

JON W. DUDAS
*Director of the United States Patent and Trademark Office*